United States Patent [19]

Funatogawa

[11] Patent Number: 4,936,300

[45] Date of Patent: Jun. 26, 1990

[54] APPARATUS FOR AUTOMATICALLY STRETCHING ACHILLES' TENDON

[76] Inventor: Hiroyuki Funatogawa, 3208-1 Tori 5-Chome, Ashikaga-City, Japan

[21] Appl. No.: 202,541

[22] Filed: Jun. 6, 1988

[51] Int. Cl.[5] ..... A63B 23/04; A61H 1/02

[52] U.S. Cl. ..... 128/25 B; 272/96

[58] Field of Search ..... 128/25 B, 25 R, 24; 272/94, 96, 93

[56] References Cited

U.S. PATENT DOCUMENTS

| | | | |
|---|---|---|---|
| 1,948,534 | 2/1934 | Nelson et al. | 128/25 B |
| 3,318,304 | 5/1967 | Gurewich | 128/25 B |
| 3,580,244 | 5/1971 | Graves | 128/25 B |
| 3,695,255 | 10/1972 | Rodgers et al. | 128/25 B |
| 3,917,261 | 11/1975 | Small et al. | 128/25 B |
| 4,637,379 | 1/1987 | Saringer | 128/25 B |

*Primary Examiner*—Stephen R. Crow

*Attorney, Agent, or Firm*—Lorusso & Loud

[57] ABSTRACT

A compact apparatus automatically forcibly stretches the Achilles' tendon of a person lying in bed without requiring any special exertion by that person. The apparatus includes a pair of pedal plates with which the soles of the feet are placed in contact and a support shaft provided at a predetermined position between the ankle and the heel. The pedal plates are spaced apart by the support shaft to which a driving mechanism is provided for rotating the pedal plates through the support shaft reversibly through a given angle.

4 Claims, 5 Drawing Sheets

APPARATUS FOR AUTOMATICALLY STRETCHING ACHILLES' TENDON

BACKGROUND OF THE INVENTION

1. Field of the Invention

The present invention relates to a small apparatus for stretching the Achilles' tendon. The apparatus can be used in bed to forcibly stretch the Achilles' tendon and does not require any exertion by the user. The apparatus is capable of general use in homes, hospitals and the like.

2. Description of the Prior Art

With recent wide use of automobiles, people do not sufficiently exercise and, as a result, the legs, feet and Achilles' tendon naturally become weak. Particularly, in women, the Achilles' tendon is always in an unstretched state because of wearing high-heeled shoes. It is necessary to extend and stretch the Achilles' tendon.

In the past, stretching of the Achilles' tendon has required exercise based on one's will. However, people are sometimes unable to exercise due to their health conditions. Therefore there exists a need for a small apparatus for stretching the Achilles' tendon which can be used either actively or passively in homes, hospitals and the like.

SUMMARY OF THE INVENTION

It is therefore an object of the present invention to provide an apparatus for automatically stretching the Achilles' tendon which can be used while lying in bed and can be used without exertion, thus serving the rehabilitation and health of many people.

The above-described problems have been solved by the present invention which provides an apparatus for stretching the Achilles' tendon as described below.

The apparatus for automatically stretching Achilles' tendon according to the present invention comprises a pedal plate 1 with which the bottom of a foot is placed in contact, a support shaft 2 provided at a predetermined position between the ankle and the heel, the pedal plates 1 being connected to the support shaft 2 in a fixed space apart relationship, and a driving mechanism 3 adapted to reverse the pedal plates 1 thorugh the support shaft in an arbitrary range (a range in which Achilles' tendon is sufficiently extended).

DETAILED DESCRIPTION OF THE PREFERRED EMBODIMENTS

Figure 1:
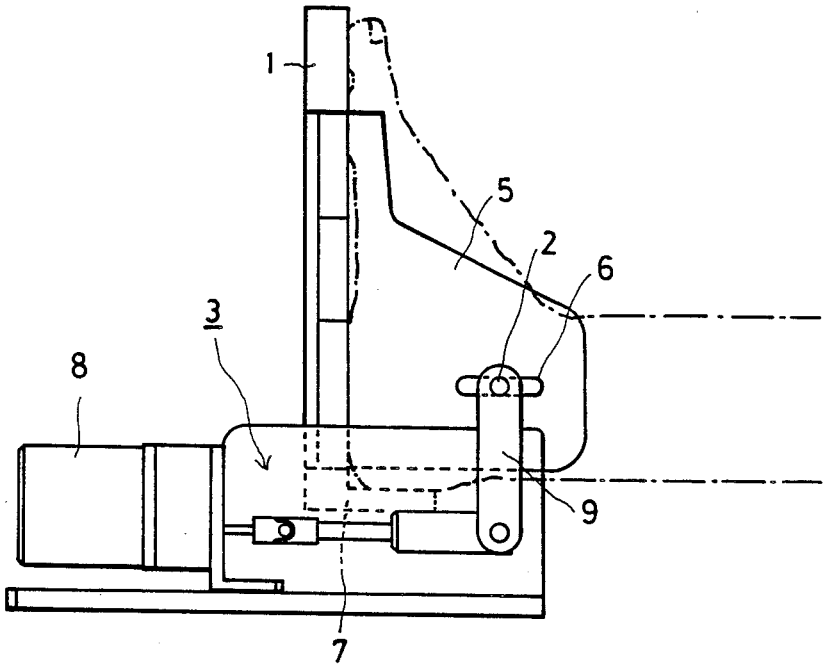
FIG. 1 is a side view of apparatus for stretching Achilles' tendon according to a first embodiment of the present invention.
Figure 2:
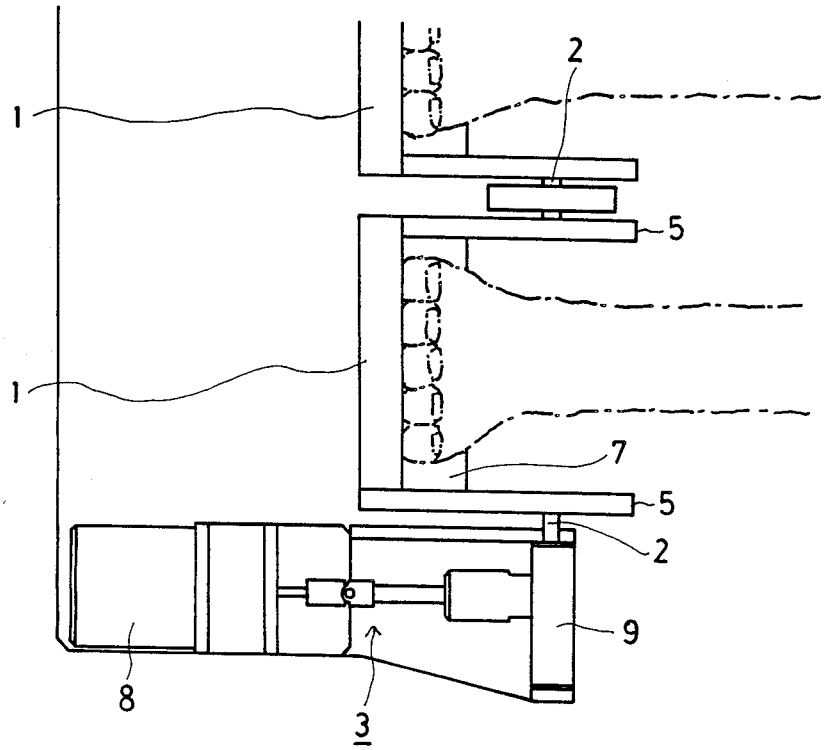
FIG. 2 is a plan view of the same.
Figure 3:
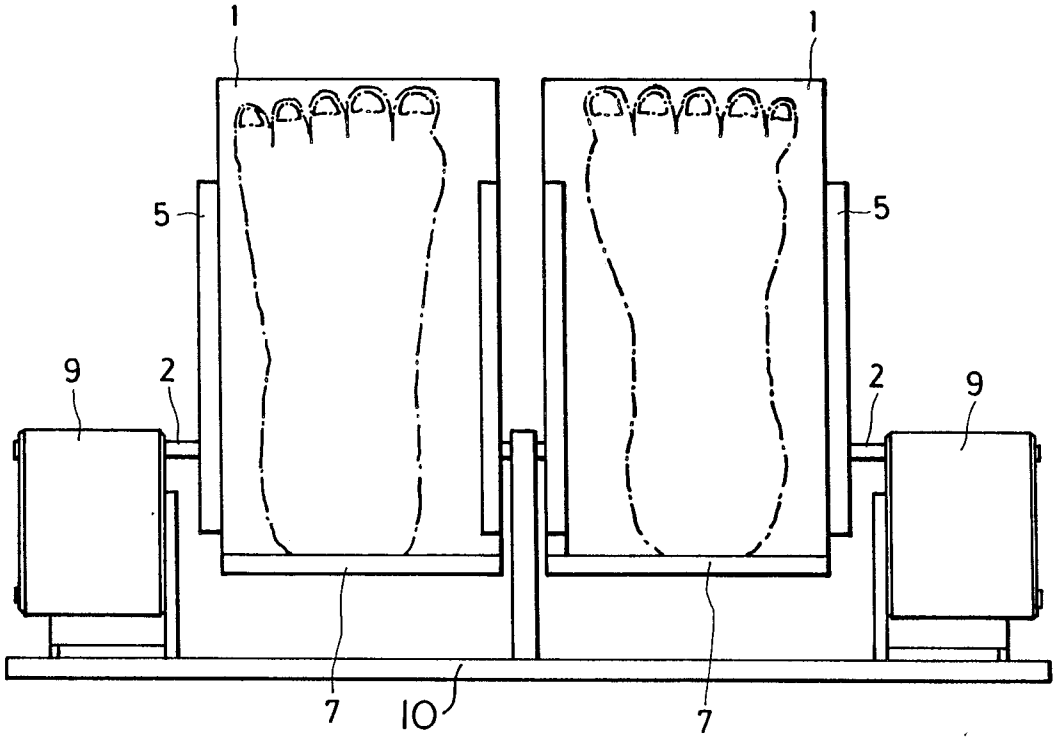
FIG. 3 is a front view of the same.

Referring to FIGS. 1 to 3, reference numeral 1 designates pedal plates with which the soles of the feet are placed in contact, 2 a support shaft serving as a rotational support, and 3 a driving mechanism for imparting a reversing rotational force to the pedal plates. The support shaft 2 and the driving mechanism 3 are mounted in a housing or frame 10.

The driving mechanism 3 is a reversible motor 8 which has a mechanism for converting its rotational force into a linear reciprocating motion and which is connected to the support shaft 2 through a link 9 for rotating support shaft 2.

The degree of stretch can be varied by adjusting the magnitude of force from the motor 8 and the interval of reversal.

The pedal plate 1 is mounted vertical so that the sole of a foot may be placed in contact therewith while the user is in a prone position. Left and right pedal plates are provided as can be seen in FIGS. 2 and 3. Accordingly, a difference in stretching between left and right feet can be provided.

The pedal plate 1 has a heel keep member 7 and a mechanism for adjusting its length. Plates 5 are connected to the support shaft 2 and extend from plates 1 on opposite sides thereof.

The points of connection between plates 5 and support shaft 2 are located so that the support shaft 2 is aligned with the ankles. A support-shaft receiving window 6 in the connecting plate 5 is formed as a somewhat elongated slot so that the support shaft 2 can be aligned with the ankle, allowing for differences in foot size.

The support shaft 2 is secured within the support-shaft receiving window 6 of the connecting plate 5. Of course, other means can be utilized to transmit the force of the driving mechanism 3 to the pedal plate 1. However, in the illustrated embodiment, the pedal plate 1 is rigidly fixed and interlocked with the reversing motion of the support shaft 2.

Figure 4:
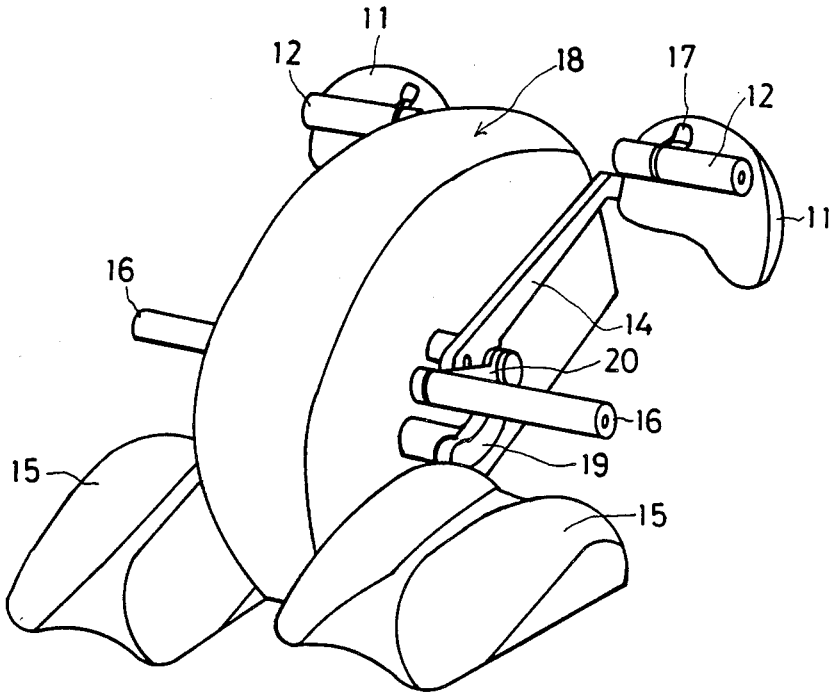
FIG. 4 is a perspective view of a second embodiment.
Figure 5:
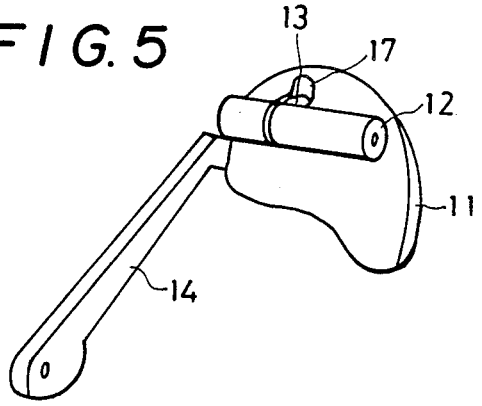
FIG. 5 is a partial perspective view showing essential parts of the second embodiment.
Figure 6:
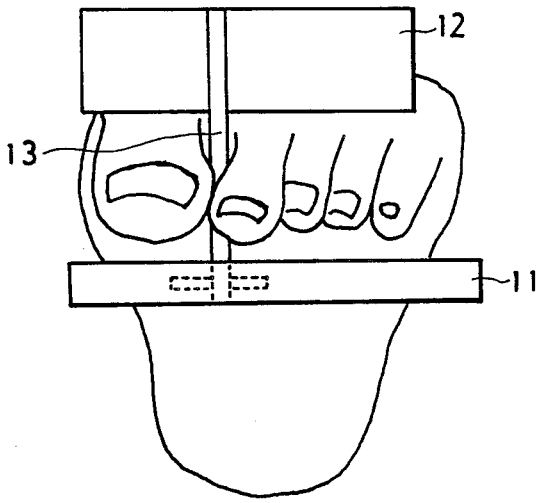
FIG. 6 is a perspective view as viewed from the toe with the foot applied to the press pedal.

FIG. 4 is a perspective view of a second embodiment of apparatus for stretching Achilles' tendon; FIG. 5 is a partial perspective view showing essential parts of the second embodiment; and FIG. 6 is a perspective view as viewed from the toe with a foot placed against the pedal plate or ball-portion press plate in accordance with the second embodiment.

Reference numeral 11 designates a pedal plate or ball-portion press plate with which the ball portion of the sole of a foot is placed in contact. The ball-portion press plate 11 is semi-circular approximately similar to the ball portion of a foot so as to facilitate contact with the ball portion of the sole of a foot. Left and right ball-portion press plates 11 are provided. Accordingly, a difference in stretching as between left and right feet can be provided. The ball-portion press plate 11 corresponds to the pedal plate 1 in the first embodiment.

The ball-portion press plate 11 is provided with an elliptical notch 17, into which is inserted an arm 13 for mounting an upper foot engaging means or a toe bar 12. The arm 13 is movable within the notch 17 to allow for adjustment of the toe bar 12.

Each press plate 11 is supported by a support shaft 21 through a connecting rod 14. The support shaft 21 does not extend through the connecting rod so as not to damage the ankle. The shaft 21 is perpendicular to and transverses an imaginary line running between the ankle and heel. Especially preferred is an intermediate position at a point in the middle of a line segment extending from the center of the ankle to the bottom of the heel. In use, the arm 13 is received between the big toe and the next adjacent toe, as shown in FIG. 6. By proper adjustment of arm 13 within notch 17 the toe bar 12 can be brought into firm contact with the instep. To better receive the toes, the arm 13 is inwardly curved. Arm 13 should be of a length allowing the ball portion of the foot to contact the ball-portion press plate 11. A toe bar 12 for engaging the upper side of the user's foot is mounted on the extreme end of the arm 13. Desirably, the toe bar 12 is positioned for contact with the base of the toes, beyond the instep. The arm 13 is adjustably mounted so that the toe bar 12 may be set to a desired position.

FIG. 4 shows an ankle keep bar or holding means 16 and a leg support bed 15. The leg support bed 15 is outwardly curved so that the leg portion immediately above the ankle at the back of the leg may rest thereon. A connecting arm 19 mounted on the housing 18 which houses the driving motor, and an ankle keep bar supporting rod 20 is connected to the connecting arm 19. An ankle keep bar 16 is mounted on the extreme end of the supporting rod 20. A spring or the like (not shown) is incorporated into the connection between the supporting rod 20 and the connecting arm 19 so that the ankle keep bar 16 may move in response to the movement of the ankle.

The effect produced by the first embodiment and its operation are described below.

First, when the electric supply is turned on to start the motor 8, the rotational force of the motor 8 is converted into a linear reciprocating motion, which is transmitted to the link 9.

For example, when the link 9 is drawn leftward in FIG. 1, the support shaft 2 secured thereto initiates its leftward rotational motion. Accordingly, the connecting plate 5 secured to the support shaft 2 and the pedal plate 1 secured thereto are also rotated leftward, that is, toward the user (rightward in FIG. 1). By this motion, the foot of the user is bent about the ankle, i.e. around the axis of the support shaft 2, whereby the Achilles' tendon is extended.

Then the motor 8 is reversed at a predetermined angle and the pedal plate 1 is returned to its initial position.

In this manner, in the present invention, the Achilles' tendon is forcibly and repeatedly extended without exertion by the user.

Figure 7:
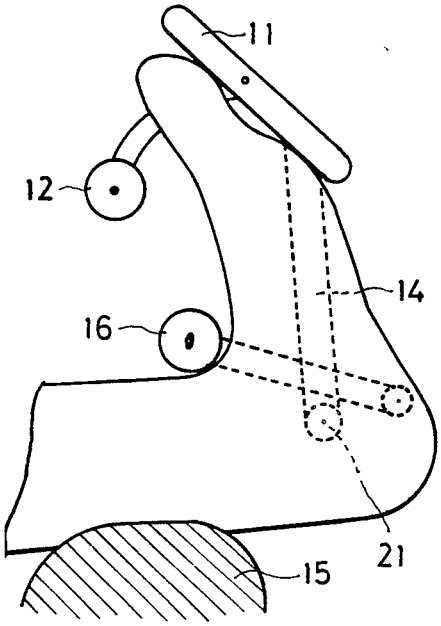
FIG. 7 is a side view showing the state wherein the foot is pressed by the press pedal.
Figure 8:
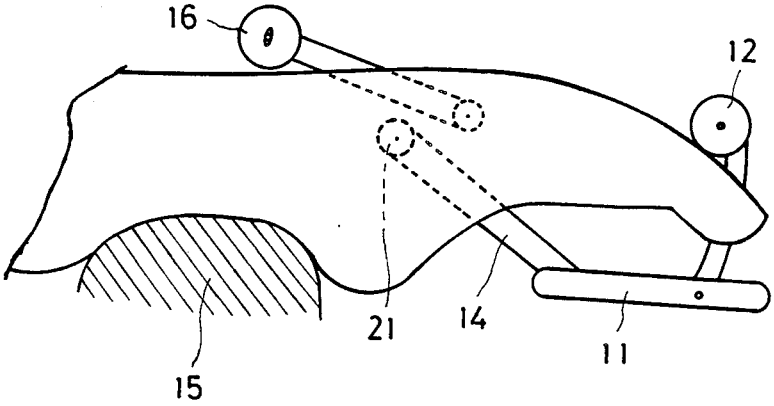
FIG. 8 is a side view showing the state wherein the toe is pressed by a toe bar.

Next, the effect produced by the second embodiment along with its operation will be described with reference to FIGS. 7 and 8.

When leftward rotational motion of the support shaft 21 starts, the connecting rod 14 secured thereto and the ball-portion press plate 11 also initiate leftward rotational motion. As a result of the leftward motion of the ball-portion press plate 11, the ball portion of the sole of the foot in contact with toe bar 12 is urged toward the user's body, and the ankle of the user is bent around the axis of the support shaft 21 as shown in FIG. 7, as a result of which Achilles' tendon is stretched. When the ankle has been bent to a predetermined extent, the support shaft 21 is reversed and starts its rightward rotational motion. As the result, the connecting rod 14 and the ball-portion press plate 11 initiate their rightward rotational motion. The user's foot has the arm 13 sandwiched between the big toe and the first toe and the toe bar 12 is in contact with the joints where the toes join the foot. Therefore, the ankle of the user is bent clockwise around the axis of the support shaft 21 as shown in FIG. 8 and the Achilles' tendon is slackened.

With provision of the leg rest bed 15 in conjunction with the ankle keep bar 16, the leg portion just above the ankle (FIG. 7) can be held locked in position during the bending of the ankle toward and away from the user'body. Therefore, the leg under the knee can be prevented from unstable movement. For this reason, stretching can be conducted more effectively.

What is claimed is:

1. An apparatus for stretching a user's Achilles' tendon, said apparatus comprising:

a housing;

a shaft supported by and extending from said housing, said shaft having an axis generally coaxial with the ankle of the user;

a pedal plate, for receiving the user's foot, supported by said shaft for rotation about said shaft to bend the user's foot about the ankle toward the user;

a leg rest for supporting the back of the user's leg just above the heel when the user's foot is engaged with said pedal plate;

holding means for holding the user's leg against said leg rest;

upper foot engaging means connected to said pedal plate, for engaging the upper side of the user's foot to press the foot toward the pedal plate and to bend the user's foot about the ankle away from the user to a point where said upper foot engaging means is approximately in line wth the leg of the user; and driving means for reversibly rotating said shaft thereby driving said pedal plate and said upper foot engaging means and alternately bending the user's foot about the ankle toward and away from the user.

2. The apparatus of claim 1 wherein said pedal plate is carried by a crank mounted on said shaft.

3. The apparatus of claim 1 further comprising mounting means for securing said upper foot engaging means onto said pedal plate at a predetermined position relative to said pedal plate for engaging the user's foot just below the toes, said mounting means comprising an arm member positioned to fit between the toes of the user's foot and fixed to said upper foot engaging means.

4. The apparatus of claim 1 wherein said upper foot engaging means is positioned to engage the user's foot at the base of the toes.

* * * * *